US006505404B2

(12) United States Patent
Ullmann

(10) Patent No.: US 6,505,404 B2
(45) Date of Patent: Jan. 14, 2003

(54) POWER DRIVEN HAIR CLIPPER

(75) Inventor: Roland Ullmann, Offenbach (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 10/081,406

(22) Filed: Feb. 20, 2002

(65) Prior Publication Data

US 2002/0083595 A1 Jul. 4, 2002

Related U.S. Application Data

(63) Continuation of application No. PCT/EP00/07392, filed on Jul. 31, 2000.

(30) Foreign Application Priority Data

Aug. 20, 1999 (DE) ..... 199 39 509

(51) Int. Cl.[7] ..... B26B 19/06
(52) U.S. Cl. ..... 30/216; 30/223
(58) Field of Search ..... 30/43, 43.7, 210, 30/216, 222, 223, 224, 199

(56) References Cited

U.S. PATENT DOCUMENTS 1,997,096 A 4/1935 Andis ..... 30/199
2,741,026 A * 4/1956 Guenther ..... 30/210
5,579,581 A * 12/1996 Melton ..... 30/223
5,606,799 A * 3/1997 Melton ..... 30/216

FOREIGN PATENT DOCUMENTS

DE 198 59 017 2/2000
GB 2 294 230 4/1996

* cited by examiner

*Primary Examiner*—Hwei-Siu Payer
(74) *Attorney, Agent, or Firm*—Fish & Richardson PC

(57) ABSTRACT

The invention is directed to a power driven hair clipper (HSM), comprising a drive mechanism provided in a housing (1) and a clipper head (S) equipped with a clipper comb (3) and a clipper blade (4) and mounted on a wall of said housing (1) for pivotal motion about a pivot axis (Z) by means of a supporting element (T), wherein the clipper head (S) has two cutting teeth rows (40, 41) arranged in opposed relation to each other, wherein the supporting element (T) releasing the cutting teeth rows (40, 41) is constructed as a housing shell (5), wherein the geometric form of the housing shell (5) is formed by a sector (SK1, SK2) of a cross sectional shape of at least one circular cylinder (Z1, Z2) as well as end walls (24, 25) associated with said sector (SK1, SK2), said end walls being constructed as part of a conical surface (KM1, KM2) with cone angles ($\alpha$1, $\alpha$2) relative to the pivot axis (Z), and wherein the housing wall (110) adjacent to the housing shell (5) has an inner contour that is essentially parallel to the outer contour of the wall of the housing shell (5).

14 Claims, 9 Drawing Sheets

POWER DRIVEN HAIR CLIPPER

This is a continuation of PCT application serial no. PCT/EP00/07392, filed Jul. 31, 2000, which claims priority from German application serial number 19939509.8, filed Aug. 20, 1999, (pending).

This invention relates to a power driven hair clipper.

A power driven hair clipper of the type initially referred to is known from U.S. Pat. No. 2,741,026. The cutting head, formed by an outer blade and an inner cutting blade driven to oscillate, is rigidly fastened to the yoke arms of the casing head constructed in a U-shaped configuration. The arcuate shape of the outer blade with its two rows of cutting teeth permits the hair clipper and the outer blade fastened thereto to execute a restricted pivot movement of 9°, while the relatively large distance of the cutting head's row of teeth used at a time to the biggest diameter of the hair clipper's casing is intended to enable both rows of teeth to be used for trimming purposes.

A power driven hair clipper of the type initially referred to is also known from U.S. Pat. No. 1,997,096, having a cutter head mounted for pivotal motion into corresponding positions for shaving and trimming, comprising a supporting element mounted for controlled pivotal motion along a curved track, a comb plate with only one row of teeth, and a cutter blade held in engagement with the comb plate by means of a resilient tension plate resting on the supporting element. An actuating element extending from the upper end of the casing transmits the driving motion to the cutter blade. A friction element acted upon by a spring element is arranged in the supporting element in such a way that it is urged against the upper surface of the hair clipper's casing in order to hold the cutter head in any given pivot position by frictional pressure engagement.

From GB 2 294 230 there is known a power driven hair clipper with a cutter head mounted for pivotal motion in all directions, whose pivotability is assured by a ball and socket connection between the housing and the cutter head. The cutter head, comprised of a supporting element and a housing cover member, includes a pair of blades, each equipped with two rows of cutting teeth extending parallel to each other but arranged in the cutter head in such a way that only one of the cooperating rows of cutting teeth on the pair of blades projects out of the cutter head housing. For the second row of cutting teeth to be brought into use, the cutter head has to be opened to enable the pair of blades to be turned through 180° inside the cutter head.

It is an object of the present invention to improve a power driven hair clipper of the type initially referred to in respect of its function and facilitate its handling.

The present invention has several advantages. One of these advantages is that the components provided for driving the clipper blade which include, for example, the bearing bracket, the clipper blade carrier with coupling elements, the locking device and the detent device, are largely encapsulated by means of the supporting element formed as a housing shell in order to prevent clipped hairs from directly entering this working area. The housing shell also enables a locking device to be arranged for fastening and removing the clipper head for cleaning and maintenance purposes, thus also making it easier to replace.

A further essential advantage of the invention results from the geometric form of the housing shell pivotally mounted on the yoke arms of the housing, and of the adjacent housing wall of the housing. The outer contour of the housing shell provided for by the invention guarantees a relatively close fit to the inner contour of the wall of the housing over the total pivot range of the housing shell. The distance between the outer contour of the housing shell and the inner contour of the wall of the housing can be selected so small that a smooth pivoting movement of the housing shell is guaranteed while, in addition, the ingress of clipped hairs into the interior of the housing is prevented. A distance of one tenth of a millimeter between the inner contour of the wall of the housing and the outer contour of the housing shell is already sufficient for a smooth pivoting movement of the clipper head and, for example, to prevent hair getting into the interior of the housing.

The operative association of two clipper blades to one clipper comb advantageously enables the rows of teeth formed by the teeth of the clipper comb and of the two clipper blades to be differently constructed, for example by having the length of extension of one row of cutting teeth significantly smaller than the length of extension of the other row of cutting teeth. Different constructions of this type guarantee that the hair clipper is put to optimal use by putting into operation the cutting teeth row best suited for the particular clipping operation. For example, clipping operations in hard to reach areas can be performed far more easily and simply with a row of cutting teeth with a smaller length of extension than with a bigger or relatively large length of extension. By contrast, cutting teeth rows with larger lengths of extension are particularly well suited for cutting contours.

A preferred embodiment of the invention is characterized in that one wall of the housing shell is definable by a circumferential surface of the sector of the circular cylinder with a radius starting from the pivot axis.

According to a further embodiment of the invention provision is made for one wall of the housing shell to be formed by the circumferential surface of two combined sectors of circular cylinders.

In a further aspect of this embodiment provision is made for the radii of the respective sectors of the circular cylinders to be of equal size. An advantage of this provision is that the volume of the housing shell available for covering clipper parts and drive elements with the housing shell is relatively amply dimensioned.

According to a further advantageous embodiment provision is made for the radii of the respective sectors of the circular cylinders to be of different size. This provision of the invention has several advantages. The different radii of the respective sectors of the circular cylinders produce a geometric form of the housing shell, in which the outer contour of the circumferential surfaces or wall of the housing shell is recessed in step shape. This step-shaped shoulder can be used, for example, as a limit stop for limiting the pivot movement of the housing shell and hence of the clipper head of the hair clipper. A further effect of this provision is that the drive elements and the clipping parts of the clipper head are closely encapsulated without any unnecessary loss of space. The space thus gained can be used, for example, to arrange further components inside the housing of the hair clipper.

According to a preferred embodiment of the invention provision is made for different lengths of extension of the circumferential surfaces of the respective sectors of the circular cylinders on the housing shell edge.

According to an advantageous embodiment of the invention provision is made for the cutting teeth rows of the clipper head to have different lengths of extension, thus enabling the optimal length of a cutting teeth row to be selected for the particular use. In a further aspect of this embodiment provision is made for the lengths of extension of the circumferential surfaces to be essentially adapted to the lengths of extension of the cutting teeth rows.

In yet another aspect of this embodiment provision is made for the geometric form of each end wall to be formed by at least two conical surfaces with different cone angles relative to the pivot axis. A particularly simple bearing arrangement of the housing shell on the wall of the housing is characterized in that one end of the conical surface of the housing shell leading to the pivot axis is constructed as a truncated cone with a bearing surface intersecting the pivot axis at right angles.

The geometric form of the inner contour of the wall of the housing is shaped to conform to the outer contour of the wall of the housing shell. This adaptation permits a variety of embodiments. According to a preferred embodiment of the invention provision is made for the conical surface of the end wall to be constructed in arcuate shape. According to a further preferred embodiment of the invention provision is made for the outer contour of the wall of the housing shell to be constructed in rectilinear and/or arcuate shape. To accommodate this geometrical construction of the housing shell provision is made in a further advantageous embodiment of the invention for the inner contour of the wall of the housing receiving the housing shell to be constructed in a rectilinear and/or arcuate shape.

A preferred embodiment of the invention is characterized in that the end of the housing is of a yoke-shaped construction and that the housing shell is pivotally mounted on the yoke arms of the housing by means of a pivot bearing.

An embodiment of the present invention will be described in the following with reference to the accompanying drawings, in which.

Figure 8A:
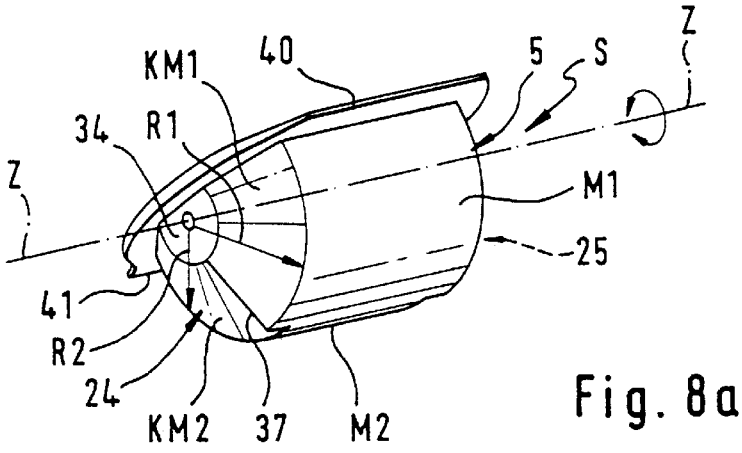
FIG. 8 is an exploded view of the upper part of a power driven hair clipper with a clipper head detached.
Figure 8:
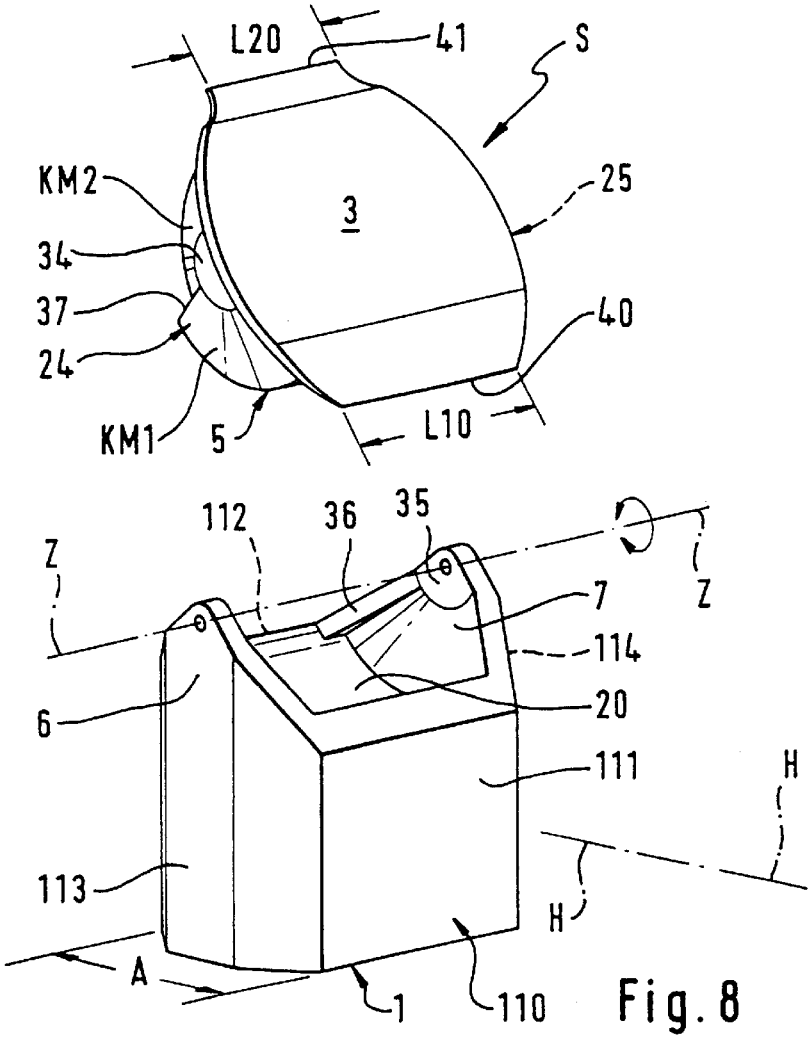
Figure 9:
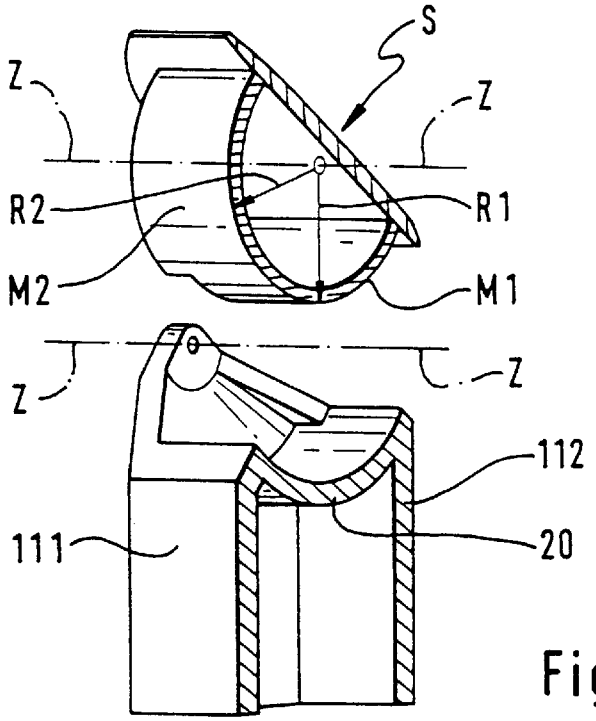
Figure 10:
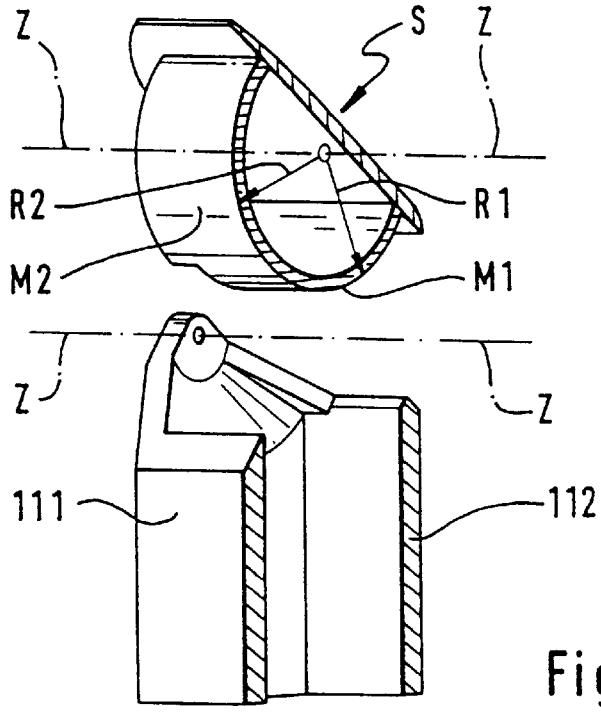
Figure 11:
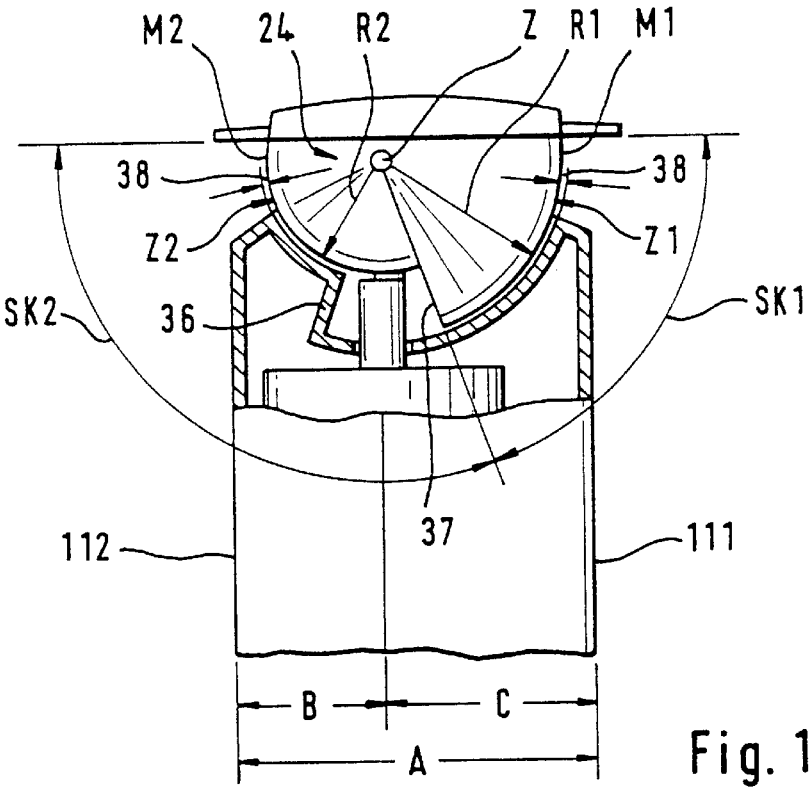
Figure 12:
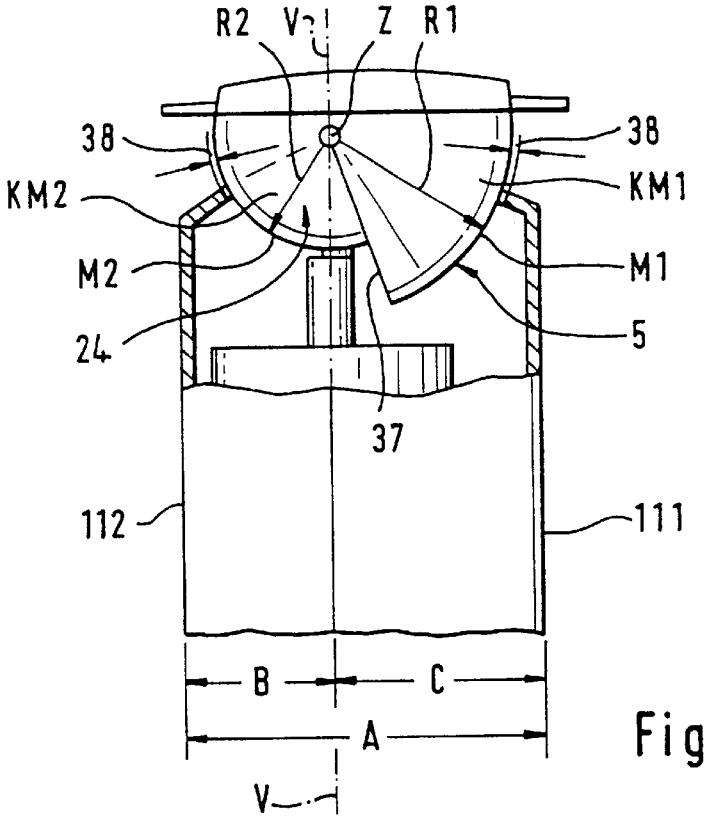
Figure 13:
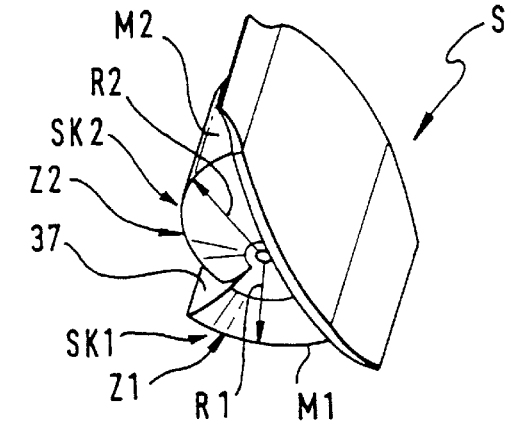
Figure 13:
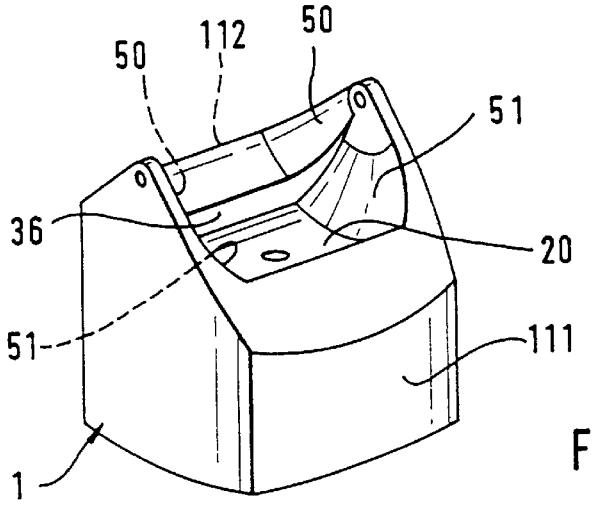
Figure 14:
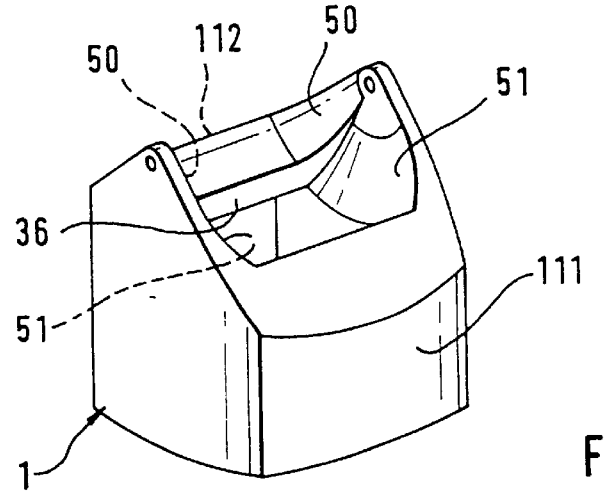

FIG. 8*a* is a perspective view of the clipper head of FIG. 8 detached from the housing, but showing it in a further position of use;

FIG. 9 is a sectional view of a power driven hair clipper of FIGS. 8 and 8*a*, showing a wall element covering the housing interior;

FIG. 10 is a sectional view of a power driven hair clipper of FIGS. 8 and 8*a*, showing a housing open in upward direction;

FIG. 11 is a sectional view of a clipper head mounted for pivotal motion about a pivot axis, with a sectional representation of part of the housing;

FIG. 12 is a sectional view of a clipper head mounted for pivotal motion about a pivot axis, with a sectional representation of part of the housing;

FIG. 13 is an exploded view of the upper part of a housing of a power driven hair clipper with a clipper head detached;

FIG. 14 is a perspective view of the upper part of a housing, absent a clipper head;

FIGS. 15 to 18 are views of the upper end of the housing wall comprised of a front wall, a rear wall and two end walls, with a pivot axis Z extending through the center of the relative distance A of the front wall to the rear wall; and FIGS. 19 to 22 are views of the upper end of the housing wall comprised of a front wall, a rear wall and two end walls, with a pivot axis Z positioned at different distances to the front wall and the rear wall.

Figure 1:
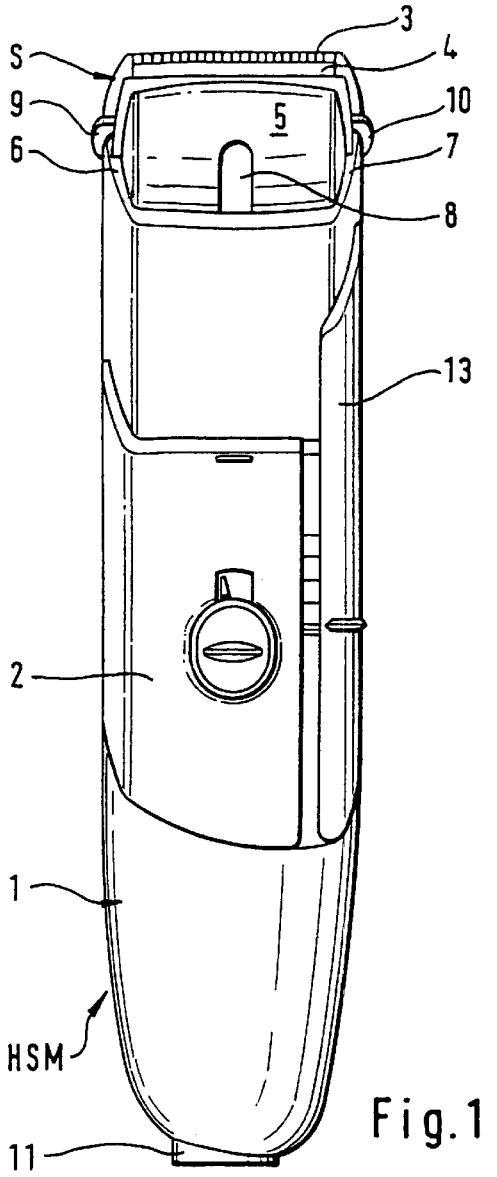
FIG. 1 is a perspective view of a power driven hair clipper, showing the actuating switch, a position switch, a supporting element constructed as a housing shell on which a clipper head is detachably held by a locking device.
Figure 5:
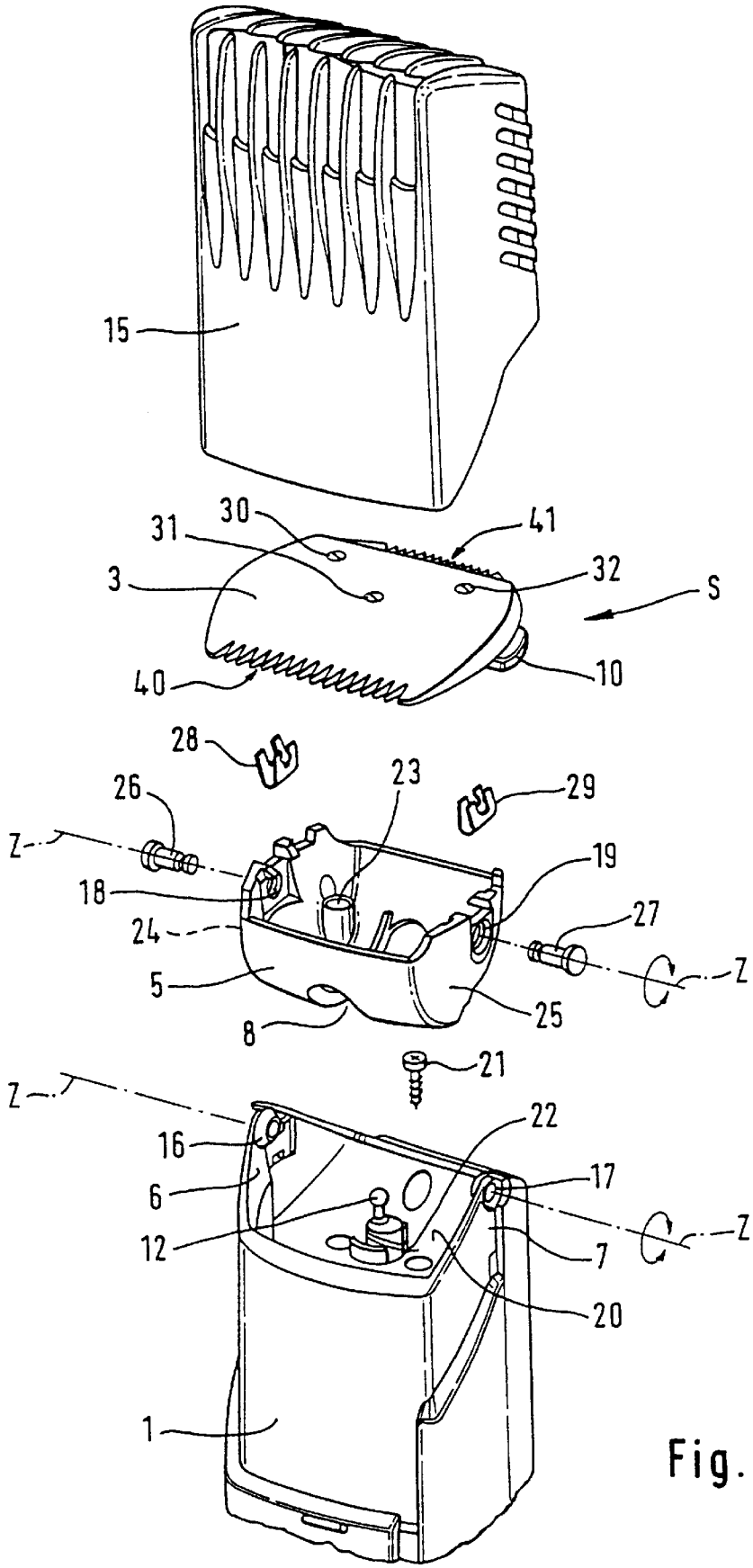
FIG. 5 is an exploded view of the upper part of a power driven hair clipper having the housing shell, the clipper head and the distancing comb detached from the clipper housing.

FIG. 1 shows the front view of a power driven hair clipper HSM with an actuating switch 2 adjustably arranged on the front panel of the housing 1, a position switch 13 and a clipper head S which has a clipper comb 3 and a clipper blade 4 and is mounted on the housing 1 for pivotal motion about a pivot axis Z—see FIG. 5. For this purpose one end of the housing 1 is of a U-shaped yoke configuration so that a supporting element 5 constructed as a housing shell is adapted to be pivotally mounted by means of pivot bearings on the yoke arms 6 and 7. In the cylindrically shaped wall of the housing shell 5 provision is made for a cutout 8 to couple a drive member 12—see FIG. 5—of an electric drive mechanism provided in the housing 1 with a drivable clipper blade 4 in dependence upon the pivot position of the clipper head S relative to the housing 1. The clipper head S is releasably attached to the housing shell 5 by means of a locking device 9, 10. At the end of the housing 1 remote from the clipper head S provision is made for an appliance socket 11 for indirect and/or direct operation of the hair clipper HSM.

Figure 2:
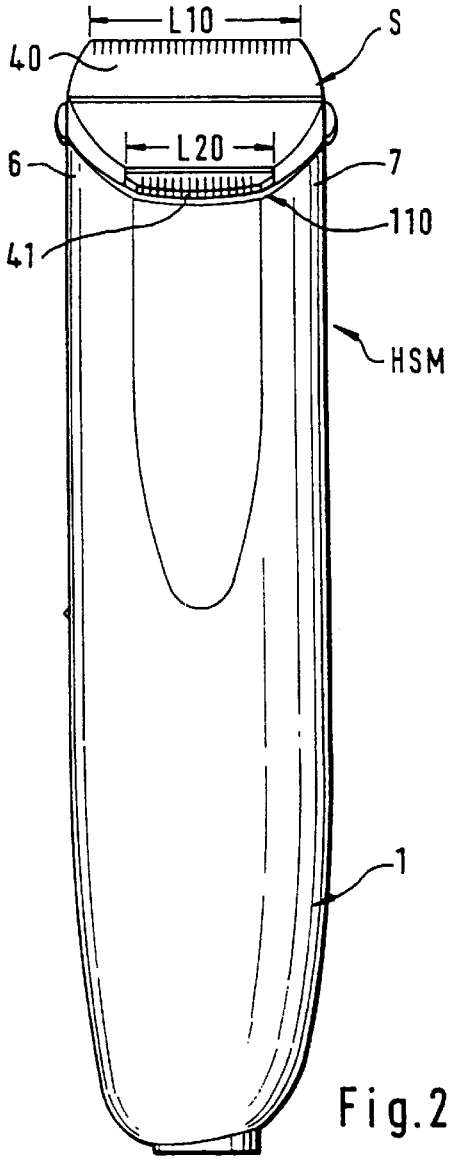
FIG. 2 is a rear view of the power driven hair clipper, showing a clipper head in a tilted position and with cutting teeth rows of different length.
Figure 6:
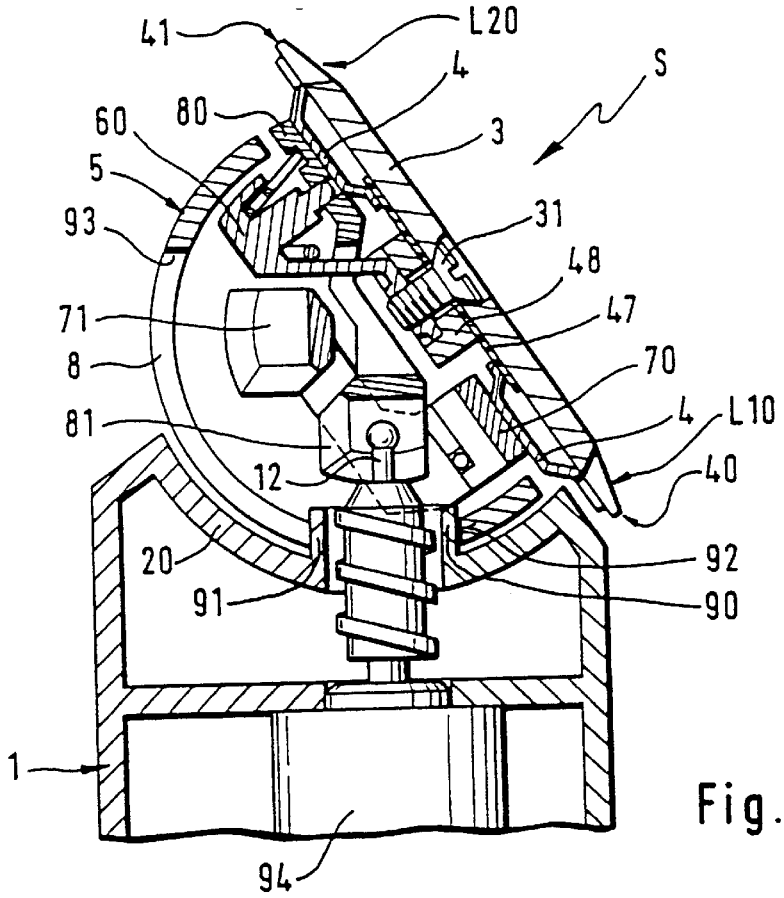
FIGS. 6 and 7 are cross sections taken through the center of the clipper head S and the upper part of the housing, showing the clipper head in different positions.
Figure 7:
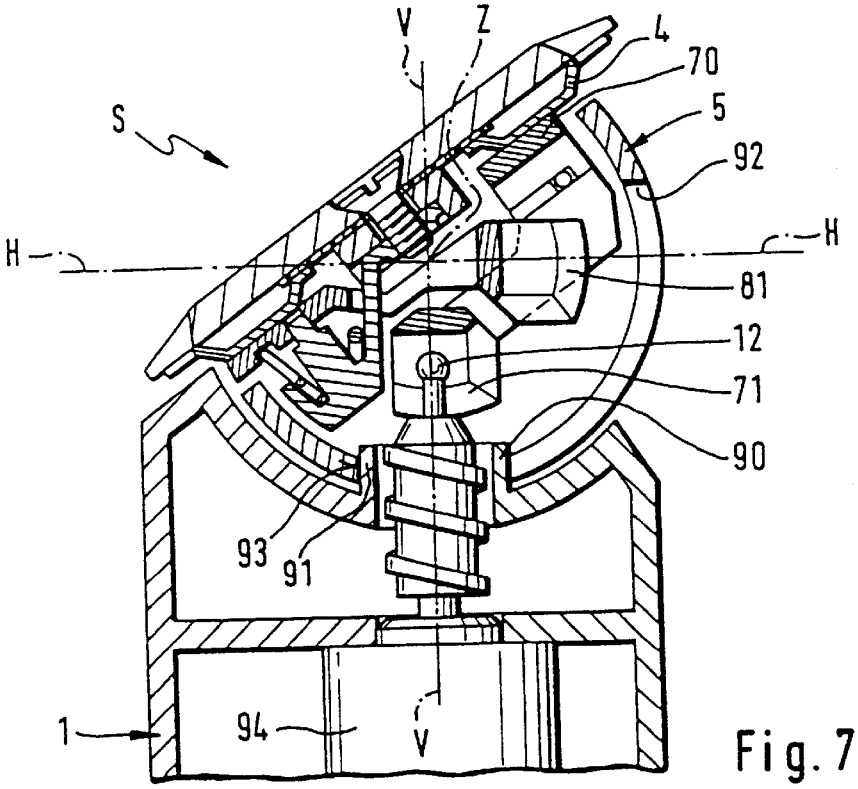

FIG. 2 is a rear view of the power driven hair clipper HSM showing a clipper head S in a tilted position—see FIGS. 6 and 7—with cutting teeth rows 40, 41 of different length, whose respective length of extension parallel to a horizontal axis H is identified with L10 and L20.

Figure 3:
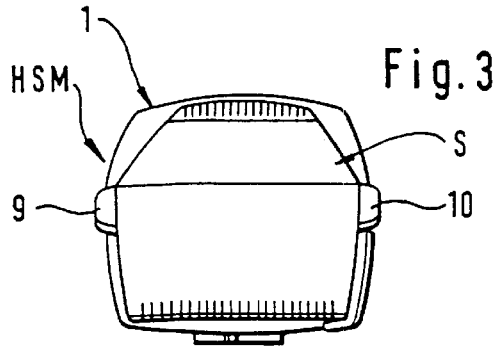
FIG. 3 is a top plan view of the power driven hair clipper, showing a clipper head positioned on the top end of the housing and detachably held by a locking device.

FIG. 3 is a top plan view of the power driven hair clipper HSM, showing a clipper head S that is positioned on the top end of the housing 1 and detachably held by the locking device 9, 10.

Figure 4:
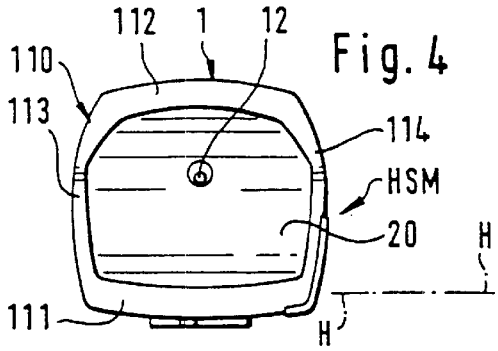
FIG. 4 is a top plan view of the upper end of the housing wall comprised of a front wall, a rear wall and two end walls, showing a wall element which covers the interior of the housing and is penetrated by a drive member.

FIG. 4 is a top plan view of the upper end of the housing wall 110, which is comprised of a front wall 111, a rear wall 112 and two end walls 113, 114, of the housing 1 of the power driven hair clipper HSM, absent the clipper head S and absent the housing shell 5, but with a wall element 20 which closes off the interior of the housing 1 and is penetrated by the drive member 12.

FIG. 5 is an exploded view of the upper part of a power driven hair clipper HSM showing the housing shell 5, the clipper head S attachable thereto and a distancing comb 15 detached from the housing 1. The upper end of the housing 1 is of a yoke-type construction, with conical bearing elements 16 and 17 being integrally formed on the yoke arms 6 and 7 in order to provide a pivot bearing in conjunction with the conical bearing elements 18 and 19 of the housing shell 5. Between the two yoke arms 6 and 7 a wall element 20 constructed like a shell is fastened to the housing 1 by means of fastening elements 21 in order to prevent hair dust getting into the interior space of the housing 1. In the middle of the wall element 20 provision is made for an opening 22 through which the drive member 12 of an electric drive mechanism accommodated in the housing 1 extends.

The housing shell 5 is of an essentially trough-shaped configuration with a cutout 8 for passage of the electric drive member 12, and with an integrally formed chamber 23 for accommodating the components of a detent device RV. The conical bearing elements 18 and 19 are provided in opposing end walls 24 and 25 of the housing shell 5. The housing shell 5 is held for pivotal motion about the pivot axis Z by means of bearing pins 26 and 27 and spring elements 28 and 29 and the conical bearing elements 16 and 17 as well as 18 and 19.

The clipper head S is releasably attached to the supporting element 5 by means of at least the locking device 9, 10—see FIGS. 1, 5. The clipper comb 3 of the clipper head S has two rows of cutting teeth 40, 41 extending parallel to the pivot axis Z and arranged in opposed relation to each other along the longitudinal sides of the clipper comb 3. The length of extension L20 of the cutting teeth row 41 is smaller than the length of extension L10 of the cutting teeth row 40. The heads of the illustrated fastening screws 30, 31 and 32 serve to fasten components of the clipper head S.

FIGS. 6 and 7 show a cross section through the middle of the clipper head S and the upper part of the housing 1, from which it will be seen that the respective position of the clipper head S and hence of the cutting system being put to use, comprised of a clipper comb 3 and a clipper blade 4, is defined by stops 90, 91, 92, 93 which are provided, for example, on the wall element 20, on the housing shell 5, or are formed by a detent device provided in the chamber 23—see FIG. 5. The stops 92 and 93 can be formed, for example, by means of the elongated cutout 8 provided in the housing shell 5. Arranged in the housing 1 is an electric motor 94 whose drive member 12, configured as an eccentric device, engages in a coupling element 81 in order to drive the respective cutting system of the clipper head S comprised of the clipper comb 3 and the clipper blade 4, then in operating position. The coupling element 71 provided to drive the clipper blade 4 is disengaged from the drive member 12. The operating position of the cutting teeth row 41 with the length of extension L20—see FIG. 2—is defined according to FIG. 6 by abutment of the stop 92 of the housing shell 5 with the stop 90 of the wall element 20 of the housing 1. In the embodiment of FIG. 6 a bearing bracket 60, a chassis 48 and a foil 47 are fastened to the planar inner surface of the clipper comb 3 by means of the fastening screw 31. The clipper blade 4 fastened to a driving element 70 and the clipper blade 4 fastened to a driving element 80 bear with their longitudinally extending engagement surfaces against the foil 47 and, on account of the thickness of the foil 47, adopt a slightly tilted position toward the respectively provided cutting teeth row 40 and cutting teeth row 41.

In contrast to the representation of FIG. 6, the clipper head S in the embodiment of FIG. 7 is pivoted by a predetermined angle relative to a vertical axis V and a horizontal axis H about the pivot axis Z, whereby the stop 93 comes to rest against the stop 91. In this position of the clipper head S the drive member 12, constructed as an eccentric device, of the electric motor 94 is coupled with the coupling element 71, causing the driving motion of the electric motor 94 to be transmitted in the activated state via the provided driving element 70 to the clipper blade 4 so that the clipper head S, then in operating position, can be used to cut hair.

FIG. 8 shows an exploded view of the upper part of a power driven hair clipper HSM with a detached clipper head S. In this embodiment the housing 1 is comprised of a front wall 111, a rear wall 112, two end walls 113 and 114 and a wall element 20 of a shell-shaped configuration which is provided at the lower end of the two yoke arms 6 and 7 in order to prevent hair dust from entering the interior of the housing.

The yoke arms 6 and 7 of the end walls 113 and 114 have an essentially triangular contour, as a result of which the end walls 113 and 114 take on a contour that extends obliquely to the pivot axis Z on both sides of the pivot axis Z. This configuration of the end walls 113 and 114 ensures a pivot motion of the clipper head S about the pivot axis Z in accordance with the angle which the respective obliquely extending end walls 113, 114 of the yoke arms 6 and 7 adopt in relation to a horizontal plane or axis H.

The clipper head S removed from the housing 1 has two cutting teeth rows 40 and 41 arranged in opposed relation to each other, with the length of extension L10 of the cutting teeth row 40 exceeding the length of extension L20 of the cutting teeth row 41. The end wall 24 of the housing shell 5 has three geometrical surfaces that differ from each other, namely a conical surface KM1, a further conical surface KM2, and a bearing surface 34. The opposite end wall 25 of the housing shell 5 is constructed in accordance with the end wall 24, as a result of which the clipper head S can be pivotally mounted by means of the bearing surface 34 on the bearing surfaces 35 provided on the yoke arms 6 and 7 of the housing 1. The cutting teeth row 41 comes into use in the position of the clipper head S illustrated in FIG. 8.

The cutting teeth row 40 comes into use in the tilted position of the clipper head S illustrated in FIG. 8A. The wall of the housing shell 5 is formed by the circumferential surface M1 and M2 of a circular cylinder Z1 and Z2 with a radius R1, R2 starting from the pivot axis Z, and by the respective end walls 24 and 25 of the circular cylinders Z1 and Z2, which have different conical surfaces KM1 and KM2. In the embodiment of FIG. 8A the radii R1 and R2 of the circular cylinders Z1 and Z2, for example, are of equal size.

In the embodiment of FIG. 8 the pivot axis Z extends through the center of the relative distance A of the front wall 111 to the rear wall 112. Considering that the respective conical surfaces KM1 and KM2 are adapted in their geometrical construction to the respective length of extension L20 and L10 of the cutting teeth rows 40 and 41, the result is a step-shaped shoulder 37 from the conical surface KM1 to the conical surface KM2. To accommodate this geometrical form of the housing shell 5 provision is made on the ends of the yoke arms 6 and 7 on the side adjacent the conical surface KM1 and KM2 for a respective shoulder 36, such that on the whole the housing wall 110 has an inner contour that is essentially parallel to the outer contour of the wall of the housing shell 5.

FIGS. 9 and 10 show a section through a power driven hair clipper HSM of FIGS. 8 and 8A, the difference being that in the embodiment of FIG. 9 the front wall 111 is connected to the rear wall 112 by a wall element 20 of a shell-type configuration, whereas in the embodiment of FIG. 10 no provision is made for a wall element 20 between the front wall 111 and the rear wall 112. From the sectional presentation of the clipper head S it is clear that the circumferential surface M1 with the radius R1 is constructed to be equal to the circumferential surface M2 with the radius R2.

FIGS. 11 and 12 each show a clipper head S mounted for pivotal motion about a pivot axis Z, and a sectional presentation of the upper part of the housing 1. The pivot axis is not at the center of the relative distance A of the front wall 111 to the rear wall 112, but at a smaller distance B from the rear wall 112 and a larger distance C from the front wall 112. In these embodiments the wall of the housing shell 5 is formed by the circumferential surface M1 with the radius R1 and by the circumferential surface M2 with the radius R2 of two combined sectors SK1, SK2 of circular cylinders Z1 and Z2, respectively. Proceeding from the dimension of a semicircle, the sector angle of the sector SK1 with the radius R1 is smaller than 90° while the sector SK2 with the radius R2 is greater than 90°. Through such a construction and combination of two sectors SK1 and SK2 of two circular cylinders Z1 and Z2 with the radii R1 and R2, respectively, the result is necessarily a different geometrical construction of the conical surfaces KM1 and KM2 of the end walls 24 and 25. The front wall 111 ends at a relatively small distance, which is identified as gap 38 in FIGS. 11 and 12. The size of the gap 38 has to be calculated so that it just guarantees a smooth pivoting movement of the clipper head S about the pivot axis Z.

In the embodiment of FIG. 11 the front wall 11 and the rear wall 112 are interconnected via a wall element 20 of a shell-shaped configuration recessed in step type. The step-shaped shoulder 37 is provided at an angle to the vertical axis V intersecting the pivot axis Z such as to enable the clipper head S to execute an unhindered pivoting movement within its preset pivot range, which is defined, for example, by stops 90, 91, 92, 93 or by abutting engagement with a shoulder 36.

FIG. 13 shows a perspective view of the upper part of a housing 1 and of a clipper head S of the embodiment of FIG. 11. On account of the different sizes of the radii R1 and R2 of the circumferential surfaces M1 and M2 of the combined sectors SK1 and SK2 of the circular cylinders Z1 and Z2, the result is a step-shaped junction between these sectors SK1 and SK2, which can be used for example as a stop on a step-shaped shoulder 36 of the wall element 20 for limiting the pivot movement of the clipper head S.

In the embodiment of FIG. 14 the step-shaped shoulder 36 is provided on the inner side of the rear wall 112 for want of a wall element 20. To accommodate the outer contour of the housing shell 5 the walls of the housing 1 adjacent the housing shell 5 have an inner contour that is essentially parallel to the outer contour of the circumferential surfaces M1 and M2 and of the conical surfaces KM1 and KM2. The inner surfaces 50 and 51 existing respectively on the insides of the yoke arms 6 and 7 are shaped to conform to the outsides of the conical surfaces KM1 and KM2.

FIGS. 15 to 21 show views of the upper end of the housing wall 110, which is comprised of a front wall 111, a rear wail 112 and two end walls 113 and 114, of the housing 1 of the power driven hair clipper HSM, absent the clipper head S and absent the housing shell 5 but with a wall element 20 which closes off the interior of the housing 1 and is penetrated by the drive member 12.

Figure 15:
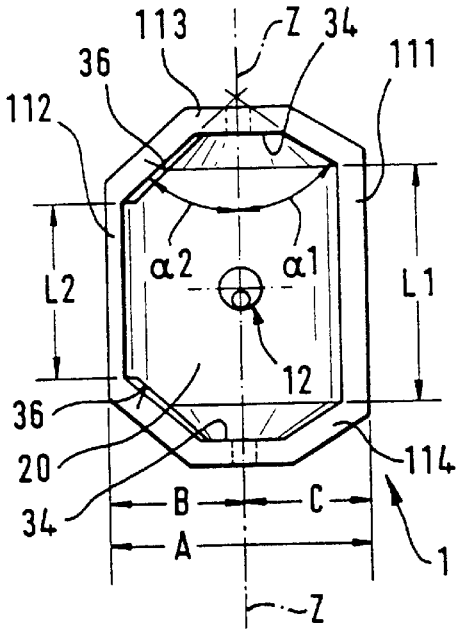
Figure 16:
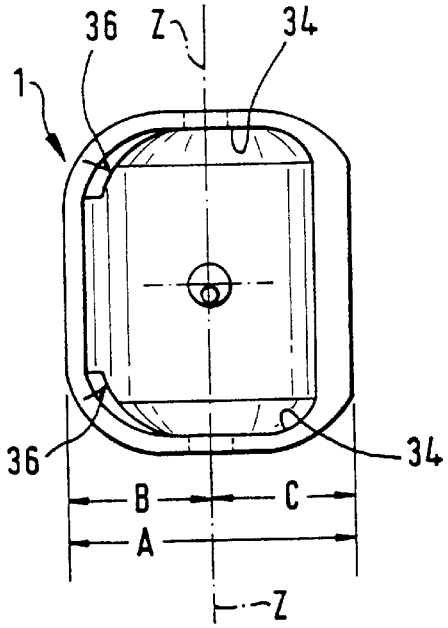

In the embodiments of FIGS. 15 to 18 the pivot axis Z extends on the center of the relative distance A of the front wall 111 to the rear wall 112. This means that the distances B and C are of equal magnitude. In the embodiment of FIG. 15 the inner contour of the housing wall 110 formed by the front wall 111, the rear wall 112 and the end walls 113 and 114 is of a rectilinear configuration, at least along the wall edges of these walls. According to an alternative embodiment illustrated in FIG. 16 the inner contour of the end walls 113 and 114 is shaped in an arcuate configuration at the wall ends, and the adjoining inner contour of the front wall 111 and the rear wall 112 is shaped in a rectilinear configuration at the wall ends. According to a further embodiment presented in FIG.16 the inner contour of the respective ends of the end wall 113 and 114 is shaped in a rectilinear configuration, while the respective ends of the inner contour of the front wall 111 and rear wall 112 are shaped in an arcuate configuration.

Figure 17:
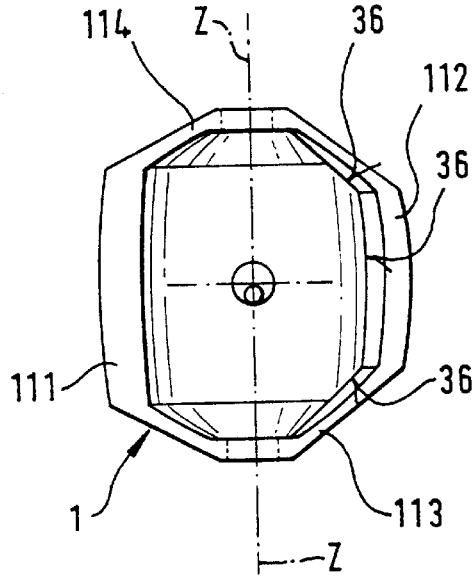

FIG. 17 shows an embodiment in which the inner contour of all the walls of the housing wall 110 is shaped in an arcuate configuration at the wall ends. As the inner contour of the housing wall 110 is shaped to conform to the outer contour of the housing shell 5, the different lengths of extension of the circumferential surfaces M1 and M2—see FIGS. 13 and 14—result in step-shaped shoulders 36 on the end walls 113 and 114—see FIGS. 15 and 16—as well as in an additional step-shaped shoulder 36 on the rear wall 112 of the embodiment of FIGS. 16 and 17.

Figure 18:
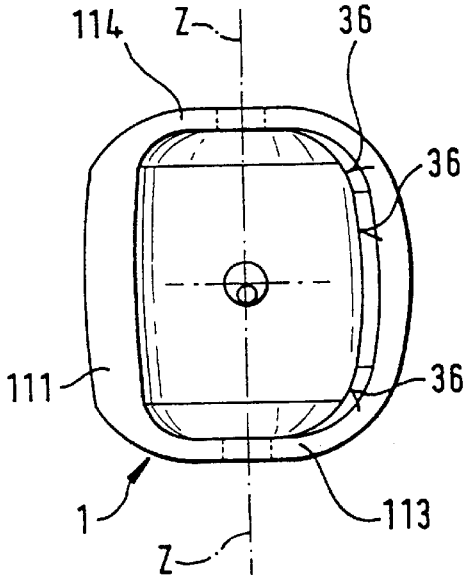

In FIGS. 19 to 22 the pivot axis Z is not on the center of the relative distance A of the front wall 111 to the rear wall 112, but at a smaller distance B from the front wall 111 and a larger distance C from the rear wall 112. When the different lengths of extension of the circumferential surfaces M1 and M2 of a housing shell 5 are taken into account—see FIGS. 13 and 14—the result is an inner contour for the end walls 113 and 114 of the housing wall 110 with cone angles $\alpha 1$ and $\alpha 2$ of different size relative to the pivot axis Z. In consequence, the step-shaped shoulder 36 on the front wall, which forms a housing surface and partly merges into the end wall 113 and 114, is appreciably thicker in construction in the embodiments of FIGS. 19 to 22 than is the case in the embodiments of FIGS. 15 to 18. In the embodiment of FIG. 18 the inner contour of the end wall 113 and 114 of the housing 1 extends parallel to a given arcuate contour of the conical surfaces KM1, KM2 of a housing shell 5, while the inner contour of the front wall 111 and rear wall 112 is rectilinear.

Figure 19:
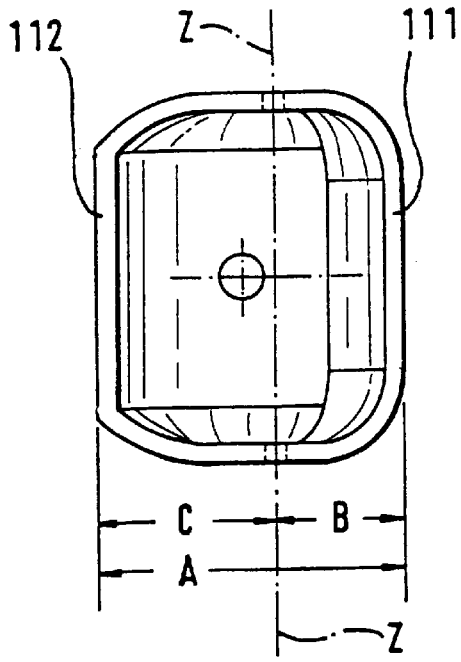
Figure 20:
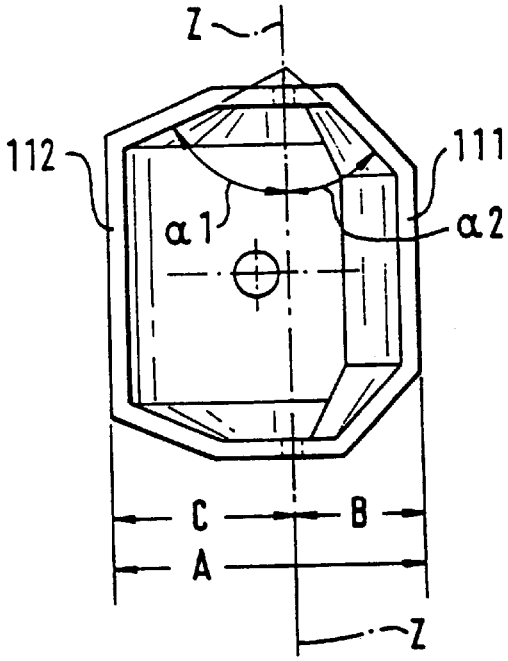
Figure 21:
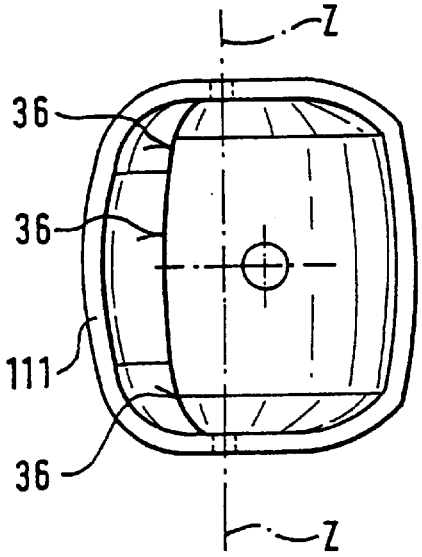
Figure 22:
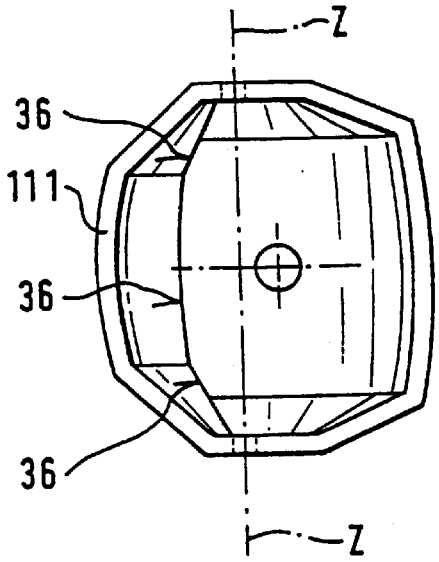

The embodiments of FIGS. 19 and 20 and 21 show inner contours of housing walls 110 that are constructed in rectilinear or arcuate shape or are comprised of a combination of rectilinear inner contours and arcuate inner contours with which correspondingly formed outer contours of the housing shell 5 are associated.

The design variant "arcuate shape" used in conjunction with an inner contour and/or outer contour—as an alternative to a rectilinear inner contour and/or outer contour—is understood to be a relatively slight curvature of end wall edges of the housing wall 110 and/or surfaces on the housing wall 110, and of surfaces of the housing shell 5 that are adjacent said wall edges and surfaces of the housing wall 110, such as the circumferential surface M1, M2 and the conical surface KM1, KM2, for example.

What is claimed is:

1. A power driven hair clipper comprising:

a housing;

a supporting element mounted on a wall of the housing for pivotal motion about a pivot axis;

a drive mechanism provided in the housing; and a clipper head equipped with a clipper comb and a clipper blade and mounted on the supporting element, wherein the clipper head is releasably mounted in the supporting element and has two cutting teeth rows arranged in opposed relation to each other, the supporting element includes a housing shell having a geometric form formed by a sector of a cross sectional shape of at least one circular cylinder as well as two end walls associated with said sector, said two end walls being constructed as part of a conical surface with cone angles ($\alpha 1$, $\alpha 2$) relative to the pivot axis, and the housing having an upper housing wall adjacent to the housing shell, said upper housing wall having an inner contour that is essentially parallel to an outer contour of a wall of the housing shell.

2. The hair clipper as claimed in claim 1, wherein one wall of the housing shell is definable by a circumferential surface of the sector of the circular cylinder with a radius from the pivot axis.

3. The hair clipper as claimed in claim 1, wherein one wall of the housing shell is formed by the circumferential surfaces of two combined sectors of two circular cylinders.

4. The hair clipper as claimed in claim 3, wherein the radii of the respective sectors of the two circular cylinders are equal.

5. The hair clipper as claimed in claim 3, wherein the radii of the respective sectors of the two circular cylinders are unequal.

6. The hair clipper as claimed in claim 3, wherein the circumferential surfaces of the respective sectors of the two circular cylinders have corresponding extensions on a housing shell edge that differ in length.

7. The hair clipper as claimed in claim 3, wherein the two cutting teeth rows of the clipper head have different lengths of extension.

8. The hair clipper as claimed in claim 7, wherein the circumferential surfaces have lengths of extension that are essentially adapted to the lengths of extension of the two cutting teeth rows.

9. The hair clipper as claimed in claim 1, wherein the cone angles ($\alpha$1, $\alpha$2) relative to the pivot axis are different.

10. The hair clipper as claimed in claim 1, wherein the conical surface of each of the two end walls is constructed in arcuate shape.

11. The hair clipper as claimed in claim 1, wherein the outer contour of the wall of the housing shell is constructed in one of a rectilinear shape and an arcuate shape.

12. The hair clipper as claimed in claim 1, wherein the inner contour of the upper housing wall receiving the housing shell is constructed in one of a rectilinear shape and an arcuate shape.

13. The hair clipper as claimed in claim 1, wherein an end of the housing is of a yoke-shaped construction and has yoke arms and the housing shell is pivotally mounted on the yoke arms of the housing by a pivot bearing.

14. The hair clipper as claimed in claim 1, wherein one end of the conical surface of the housing shell leading to the pivot axis is constructed as a truncated cone with a bearing surface intersecting the pivot axis at right angles.

* * * * *